US008508516B2

(12) United States Patent
Yamashita et al.

(10) Patent No.: US 8,508,516 B2
(45) Date of Patent: Aug. 13, 2013

(54) ACTIVE MATRIX TYPE DISPLAY DEVICE AND PORTABLE MACHINE COMPRISING THE SAME

(75) Inventors: Keitaro Yamashita, Hyogo (JP); Yoshikazu Matsui, Hyogo (JP)

(73) Assignee: Chimei Innolux Corporation (TW)

( * ) Notice: Subject to any disclaimer, the term of this patent is extended or adjusted under 35 U.S.C. 154(b) by 909 days.

(21) Appl. No.: 12/572,380

(22) Filed: Oct. 2, 2009

(65) Prior Publication Data

US 2010/0085286 A1 Apr. 8, 2010

(51) Int. Cl.
*G09G 3/34* (2006.01)

(52) U.S. Cl.
USPC ..... 345/204; 345/108; 345/109; 345/211; 345/86; 345/84; 100/76

(58) Field of Classification Search
USPC ..... 345/84–86, 108–109, 211, 214, 87, 345/90, 35, 92, 98, 100, 101, 103, 204, 76; 359/230, 227; 100/76
See application file for complete search history.

(56) References Cited

U.S. PATENT DOCUMENTS

| | | | | |
|---|---|---|---|---|
| 5,581,273 | A * | 12/1996 | Yoneda et al. | 345/90 |
| 6,452,579 | B1 * | 9/2002 | Itoh et al. | 345/100 |
| 6,756,953 | B1 * | 6/2004 | Tokioka et al. | 345/87 |
| 6,943,766 | B2 * | 9/2005 | Nakamura et al. | 345/98 |
| 6,965,366 | B2 * | 11/2005 | Ozawa | 345/89 |
| 7,301,517 | B2 * | 11/2007 | Hebiguchi et al. | 345/90 |
| 7,952,546 | B2 * | 5/2011 | Sano | 345/87 |
| 8,059,218 | B2 * | 11/2011 | Yoshida | 349/33 |
| 8,368,709 | B2 * | 2/2013 | Nurmi | 345/545 |
| 2002/0047822 | A1 * | 4/2002 | Senda et al. | 345/90 |
| 2002/0196208 | A1 * | 12/2002 | Nanno et al. | 345/55 |
| 2003/0098860 | A1 * | 5/2003 | Nakamura et al. | 345/211 |
| 2006/0181495 | A1 * | 8/2006 | Edward | 345/92 |
| 2006/0232577 | A1 * | 10/2006 | Edwards et al. | 345/211 |
| 2006/0250332 | A1 * | 11/2006 | Lo et al. | 345/76 |
| 2008/0316150 | A1 * | 12/2008 | Lee et al. | 345/76 |
| 2009/0085858 | A1 * | 4/2009 | Hsu et al. | 345/100 |
| 2009/0273388 | A1 * | 11/2009 | Yamashita | 327/416 |
| 2010/0177083 | A1 * | 7/2010 | Yamashita | 345/211 |
| 2012/0019436 | A1 * | 1/2012 | Yamashita | 345/76 |

FOREIGN PATENT DOCUMENTS

| | | | |
|---|---|---|---|
| EP | 1158482 | A2 * | 11/2001 |
| JP | 10253941 | | 9/1998 |
| JP | 2001305511 | | 10/2001 |
| JP | 2002229528 | | 8/2002 |
| JP | 2003108031 | | 4/2003 |
| JP | 2003228347 | | 8/2003 |
| JP | 2004191574 | | 7/2004 |
| JP | 2005-148425 | A | 6/2005 |
| JP | 2007-328351 | A | 12/2007 |

OTHER PUBLICATIONS

Office Action mailed Sep. 24, 2010 from Corresponding Japanese Application No. 2008-260744.

* cited by examiner

*Primary Examiner* — Lun-Yi Lao
*Assistant Examiner* — Kelly B Hegarty
(74) *Attorney, Agent, or Firm* — Lowe Hauptman Ham & Berner, LLP

(57) ABSTRACT

A display device includes a plurality of pixels arranged in a matrix with columns and rows. A source driver provides either analogue or digital image data for the pixels. Each pixel includes a plurality of sub-pixels. Each sub-pixel includes a display components, a memory unit for memorizing gradation display data included in the digital image data provided by the source driver for the display component, and a data switching unit for switching data providing for the display component to either the gradation display data memorized in the memory unit or the analogue image data provided by the source driver.

10 Claims, 10 Drawing Sheets

ACTIVE MATRIX TYPE DISPLAY DEVICE AND PORTABLE MACHINE COMPRISING THE SAME

CROSS REFERENCE TO RELATED APPLICATIONS

This Application claims priority of Japan Patent Application No. 2008-260744, filed on Oct. 7, 2008, the entirety of which is incorporated by reference herein.

BACKGROUND OF THE INVENTION

1. Field of the Invention

The invention relates to an active matrix type display device and portable machine comprising the same.

2. Description of the Related Art

Liquid crystal displays (LCDs) utilize voltage to vary alignment of liquid crystal molecules, and can display images, wherein environmental light or backlight is allowed to pass through or be shielded. Presently, the typical types of LCDs comprise the transmissive type, utilizing backlight modules on the back surface of a screen to display images, the reflective type, reflecting environmental light to display images without backlight modules, and the transflective type, utilizing environmental light reflection and backlight modules.

For the above mentioned LCDs, the reflective type LCD display is the most popular utilized in machines, capable of hand carry, driven by batteries because power consumption is low due to absence of backlight modules. These machines comprise portable machines such as mobile phones and personal digital assistants (PDAs), etc. Mobile phones, for example, are mainly in a standby state when used, and usually display still images in all or most of the display part at that time. Alternatively, mobile phones also usually use low bit color functional displays like a clock display.

For conventional reflective type display devices, data is written into pixels by drivers in the same manner in either of moving pictures displaying mode and still pictures displaying mode. In this situation, typically, the same data are written into the pixels when displaying still pictures. Thus, a technology (refer to patent document 1 JP2007-328351, for example) is proposed to stop driving the driver and decrease power consumption due to disposing memories in every pixel and writing memorized data in the memories into the pixels when displaying still pictures. The technology is typically known as the MIP (memory in pixel) technology.

Further, multi-bit MIP technology has also been disclosed, achieving multi gradation display for displaying of still pictures, wherein one pixel is divided into a plurality of sub-pixels, memories are disposed in each sub-pixel, and digital data with bit numbers corresponding the sub-pixel numbers is input to the pixel (refer to patent document 2 JP2005-148425, for example).

BRIEF SUMMARY OF THE INVENTION

For conventional multi-bit MIP technology, only still pictures can be displayed with digital data. Theoretically, moving pictures can be displayed with digital data by increasing the display clock number. However, increasing the display clock number induces data transmission delays, thus hindering a smooth display of the moving pictures.

Thus, embodiments of the invention provide active matrix type display devices and portable machines comprising the same, utilizing multi-bit MIP technology to display still and moving pictures.

An embodiment of the invention provides an active matrix type display device comprising a plurality of pixels and a source driver. The plurality of pixels are arranged in a matrix with lines and rows. The source driver provides image data of data type of either analogue image data or digital image data for the plurality of pixels. The respective plurality of pixels are divided into a plurality of sub-pixels, and the plurality of sub-pixels respectively comprises a display component, a memory means, and a data switching means. The memory means memorizes gradation display data, for the display component, comprised in the digital image data provided by the source driver. The data switching means switches data, provided for the display component, to be either the memorized gradation display data in the memory means or the analogue image data provided by the source driver.

Thus, it is possible to display both still and moving pictures in an active matrix type display device utilizing multi-bit MIP technology. Specifically, a data switching means is disposed in the pixel, wherein the data provided for the display component is switched according to display modes, achieving lower power consumption, an advantage of the MIP technology, while making it possible to display moving pictures in the active matrix type display device utilizing multi-bit MIP technology.

Meanwhile, preferably, in the active matrix type display device of the embodiment, the source driver controls the switch of the data switching means according to the data type of the image data provided for the plurality of pixels.

Thus, the data switching means that switches the data providing source in the pixel can be synchronized with the image data provided from the source driver.

Also, preferably, in the active matrix type display device of the embodiment, the plurality of pixels respectively further comprises a digital-analogue converting means, converting the gradation display data from digital type to analogue type, in the respective plurality of sub-pixels when the memory means is a multi-bit memory memorizing the gradation display data which is digital data of two bits or more.

Thus, various gradation according to the gradation display data can be displayed by each sub-pixel, and the number of sub-pixels divided from one pixel can be decreased. That is, it is possible to keep a high pixel aperture ratio while achieving smooth neutral colors.

Once again, preferably, in the active matrix type display device of the embodiment, the respective plurality of pixels further comprise a demultiplexer extracting the gradation display data for the respective display components from the digital image data provided by the source driver.

Thus, the digital image data is divided into bits, and it is possible to extract the gradation display data represented by each bit.

Also, preferably, in the active matrix type display device of the embodiment, the source driver comprises a bit output sequence controlling means that controls data output of the source driver, wherein the digital image data for the plurality of pixels is provided in a sequence from a least significant bit of the digital image data for the plurality of pixels when the memory means, disposed in the respective plurality of sub-pixels comprised by the respective plurality of pixels, is renewed by new gradation display data.

Because in multi-bit MIP technology, the image profile is displayed according to the least significant bit (LSB) in the digital data provided for each pixel, it is thus possible to increase the image identification speed for viewers during renewal of the still pictures by utilizing the mechanism of visual perception of human beings.

Further, the bit output sequence controlling means controls data output of the source driver to output digital image data to the respective plurality of pixels in the sequence of the plurality of pixels, and to each plurality of pixel in a sequence from the least significant bit of the related digital image data.

The source driver can output the received image in sequence, and the memory capacity thereof can be relatively small when utilizing the control technique.

Alternatively, the bit output sequence controlling means controls data output of the source driver to respectively output a plurality of digital image data relating to the respective plurality of pixels in a sequence from the least significant bit in a predetermined unit to the respective plurality of pixels.

Because the image profile is first renewed through the whole display device when utilizing the control technique, the image identification speed according to viewers is further increased based on the mechanism of visual perception of human beings.

In one embodiment, the active matrix type display device can be a liquid crystal display device or an organic light emitting diode (OLED) display device utilizing liquid cells or organic electroluminescence materials as the light emitting display components comprised in the pixels.

In embodiments of the invention, the active matrix type display device is specifically utilized to be assembled in portable machines, such as mobile phones, personal digital assistants (PDAs), portable audio players, and portable game machines. The portable machines are typically driven by batteries. The result that the power consumption is restrained by the utilization of the active matrix type display device of embodiments of the invention, the battery power decrease is delayed compared to the conventional techniques.

Thus, embodiments of the invention can provide active matrix type display devices and portable machines comprising the same, utilizing multi-bit MIP technology, capable of display still and moving pictures.

Further scope of the applicability of the invention will become apparent from the detailed descriptions given hereinafter. It should be understood however, that the detailed descriptions and specific examples, while indicating preferred embodiments of the invention, are given by way of illustration only, as various changes and modifications within the spirit and scope of the invention will become apparent to those skilled in the Art from the detailed descriptions.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Subsequently, preferred embodiments of the invention are described with reference to the attached drawings.

Figure 1:
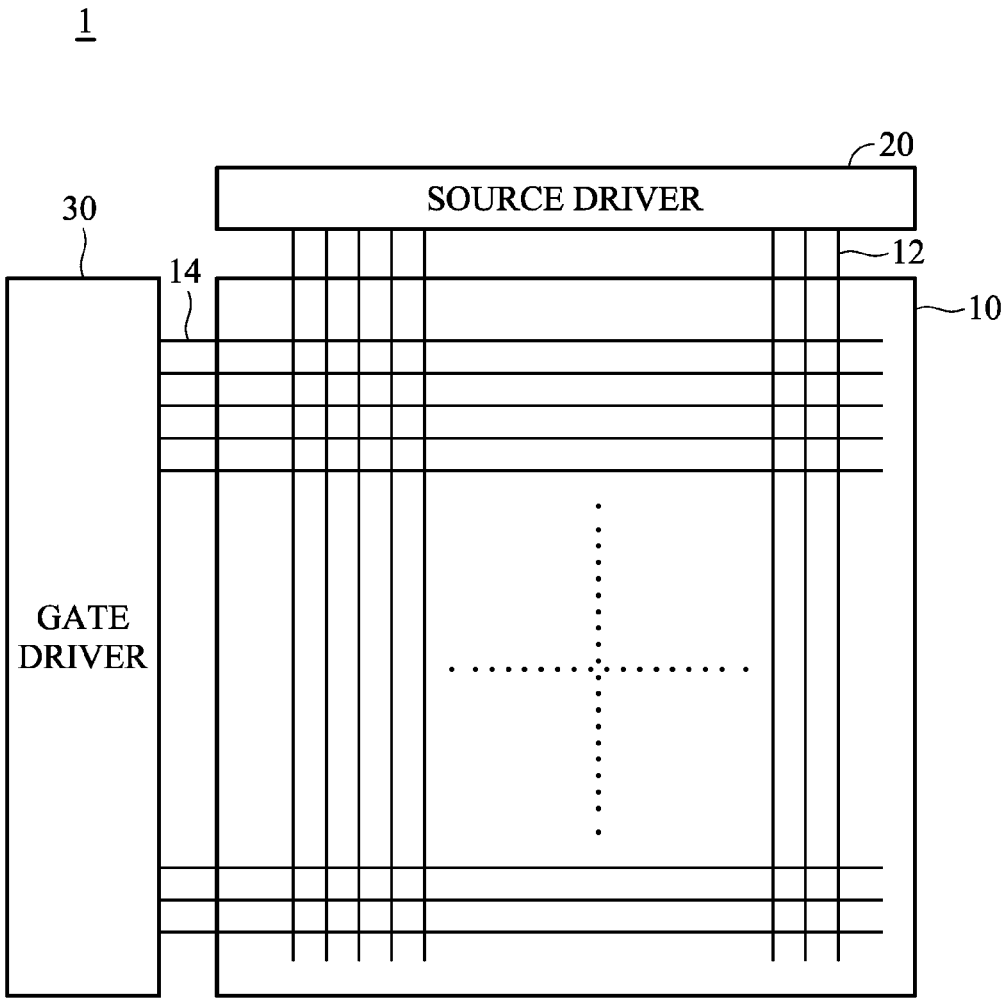
FIG. 1 shows a structure of an active matrix type display device of an embodiment of the invention.

FIG. 1 shows a structure of an active matrix type display device of an embodiment of the invention.

The display device 1 of FIG. 1 comprises a display department 10 comprising a plurality of pixels arranged in lines and rows, a source driver 20 connected to each pixel through source lines 12 and providing analogue or digital image data for the pixels, and a gate driver 30 controlling the on/off switch of each pixel through the gate lines 14.

Each pixel (not shown) is disposed in cross areas of the source lines 12 and the gate lines 14 in the display department 10, and comprises at least one display component (a liquid crystal cell, an organic electroluminescence materials, or etc., for example) and one corresponding memory in pixel. During a still picture display mode, each pixel acts according to the memorized data in the built-in memory, instead of the data transmitted through the source lines 12. Therefore, it is possible to stop the source driver 20 during the still picture display mode. Further, the display department 10 can continuously display still pictures during the still picture display mode. The details of related actions are subsequently described.

Figure 2:
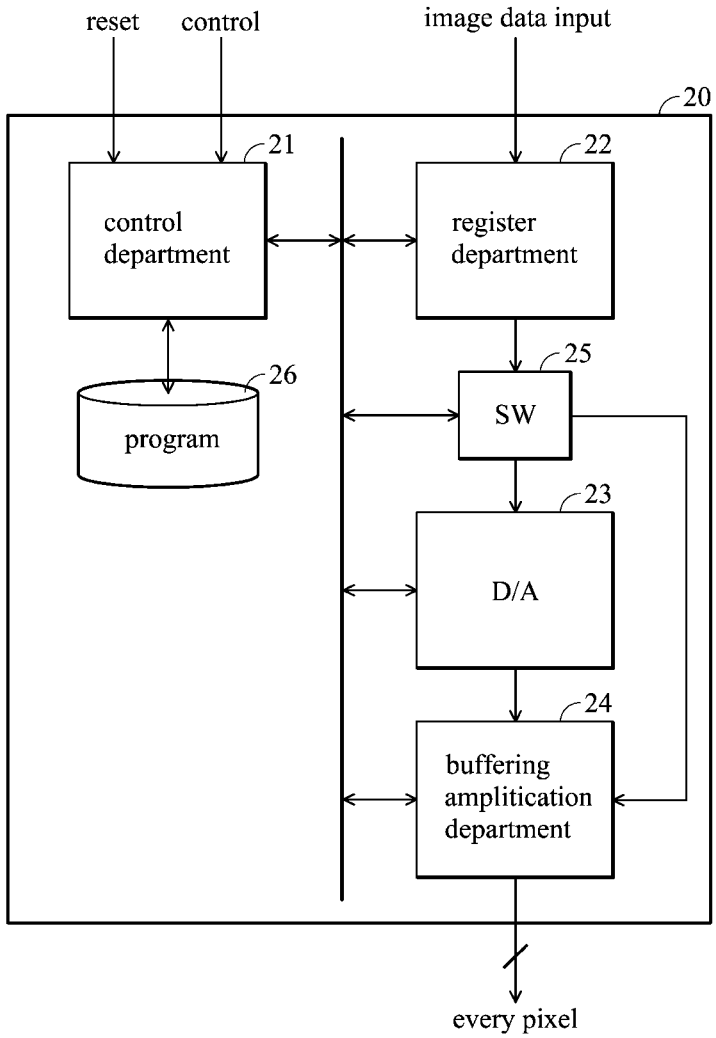
FIG. 2 shows a structure of a source driver of an embodiment of the invention.

FIG. 2 shows a structure of a source driver of an embodiment of the invention.

The source driver 20 comprises a control department 21, a register department 22, a digital-analogue converting department (D/A) 23, a buffering/amplification department 24, and a data path switching department 25. The control department 21 can control the action of each department of the source driver 20 according to a memorized program 26 in an external or built-in memory device. The register department 22 can temporally hold the digital image data provided by a controller (not shown) of a display device body. The digital-analogue converting department 23 can convert the digital data signals output by the register department 22 into analogue data signals. The buffering/amplification department 24 can perform buffering and amplification on the analogue data signals output by the digital-analogue converting department 23 or the digital data signals directly output by the register department 22, and can provide the signals for each pixel (referring to FIG. 1) of the display department through the source lines 12. The data path switching department 25 can switch the data path to provide the digital data signals output by the register department 22 for either the digital-analogue converting department 23 or the buffering/amplification department 24 according to the controlling signals from the control department 21.

The control department 21 can instruct the data path switching department 25 to switch the data path according to the controlling signals provided by the control department 21. Specifically, the control department 21 can instruct the data path switching department 25 to switch the data path to either provide the digital data signals output by the register department 22 for the digital-analogue converting department 23 in the moving picture display mode, or provide the digital data signals output by the register department 22 for the buffering/amplification department 24 in the still picture display mode.

Further, in the still picture display mode, the digital data signals, provided by the buffering/amplification department 24, are provided for each pixel, and subsequently, each pixel can perform based on the memorized data in the memory when the data are memorized in the memory in pixel. Therefore, the control department 21 can stop operations of the register department 22, the digital-analogue converting department 23, the buffering/amplification department 24, and the data path switching department 25. For these cases, the display department can still continuously display still pictures.

Figure 3A:
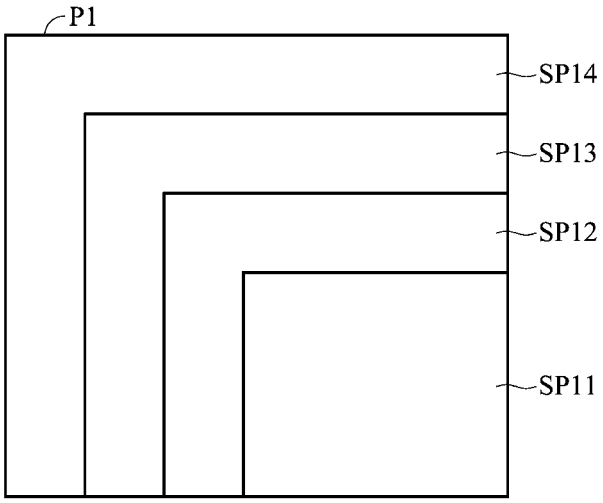
FIGS. 3*a* and 3*b* respectively show an example of a structure and shape of a pixel utilizing the multi-bit MIP technology of an embodiment of the invention.
Figure 3B:
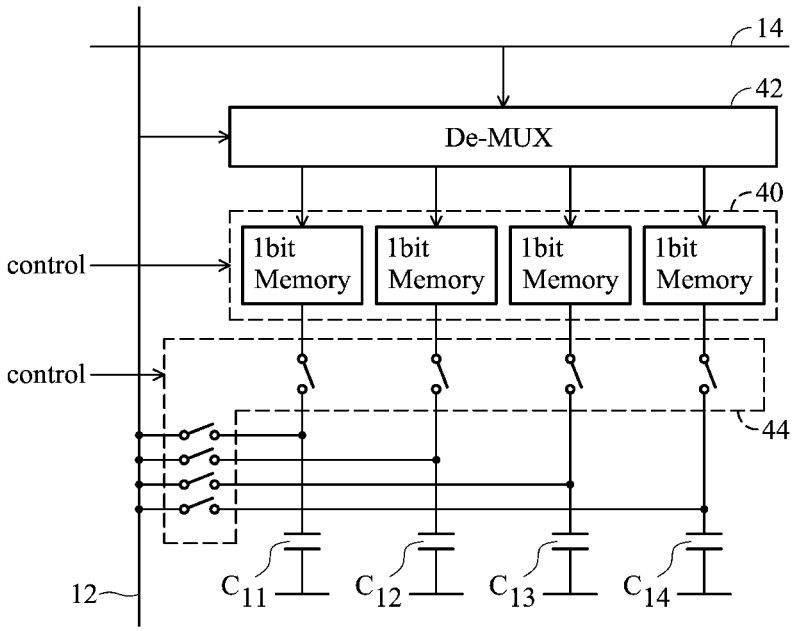

FIGS. 3*a* and 3*b* respectively show an example of a structure and shape of a pixel utilizing the multi-bit MIP technology of an embodiment of the invention.

A pixel as shown in FIG. 3*a*, for example, is divided into a plurality of sub-pixels. The pixel P1 of FIG. 3*a* comprises four sub-pixels SP11, SP12, SP13, and SP14. Each sub-pixel is capable of white display or black display. In this example, the pixel P1 is capable of sixteen gradations of gray scale display.

The pixel P1 comprises a circuitry as shown in FIG. 3*b*, for example. The pixel P1 comprises four display components C11, C12, C13, and C14 such as liquid crystal cells or organic electroluminescence materials, a memory 40 comprising four one-bit memory areas disposed corresponding to each display component, a demultiplexer 42 dividing the digital image data transmitted through the source lines 12 from the source driver 20 into bits, and a data switching department 44 switching providing either the memorized data in the memory 40 or the data transmitted through the source lines 12 for each display component.

The demultiplexer 42 divides the digital image data provided by the source driver 20 into each unit bit according to gate signals transmitted from the gate driver 30 through the gate lines 14. In this example, the digital image data provided by the source driver 20 are digital data of four bits, such as 0000 through 1111, representing display gradations of the pixel P1. Each bit of the digital data image is the gradation display data representing black/white display of each sub-pixel. The demultiplexer 42 can extract the gradation display data comprised in the digital image data, and hold the extracted data, in the memory area, corresponding to each display component of the memory 40.

The data switching department 44 can switch to either provide the analogue image data transmitted through the source lines 12 for each display component in the moving picture display mode, or provide the memorized gradation display data in the memory 40 for each pixel display in the still picture display mode, according to the controlling signals from the control department 21 of the source driver 20.

Each display component varies its optical property or emits light based on the analogue image data transmitted through the source lines 12 in the moving picture display mode, and on the other hand, based on the memorized gradation display data in the corresponding memory area of the memory 40 in the still picture display mode. The data access from the memory 40 in the still picture display mode is controlled by the control department 21 of the source driver 20. A static random access memory (SRAM) or dynamic random access memory (DRAM), for example, can be utilized as the memory 40. It is possible to decrease memory power consumption when utilizing an SRAM. Further, it is possible to decrease memory circuit size when utilizing a DRAM.

Further, the output of the demultiplexer 42 is constructed to not connect to either of the memory areas to prevent the analogue image data transmitted through the source lines 12 from outputting to the memory 40 in the moving picture display mode.

As described, it is possible to achieve low power consumption, which is an advantage of the MIP technology, and display moving pictures in active matrix type display devices utilizing the multi-bit MIP technology due to the disposition of means in the pixel for switching the data provided for the display components according to the display mode.

Figure 4A:
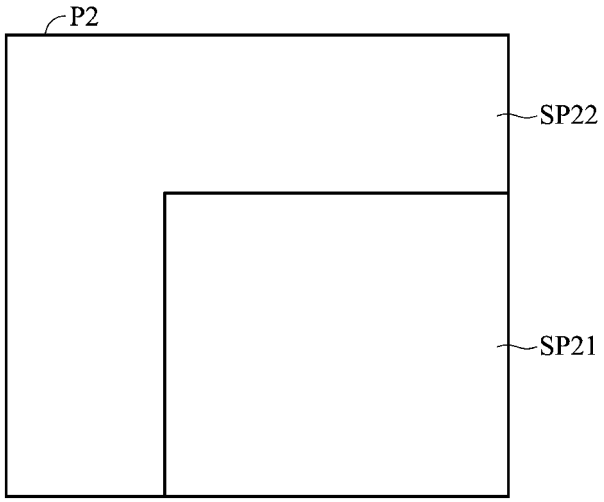
FIGS. 4*a* and 4*b* respectively show an alternative example of a structure and shape of a pixel utilizing the multi-bit MIP technology of an embodiment of the invention.
Figure 4B:
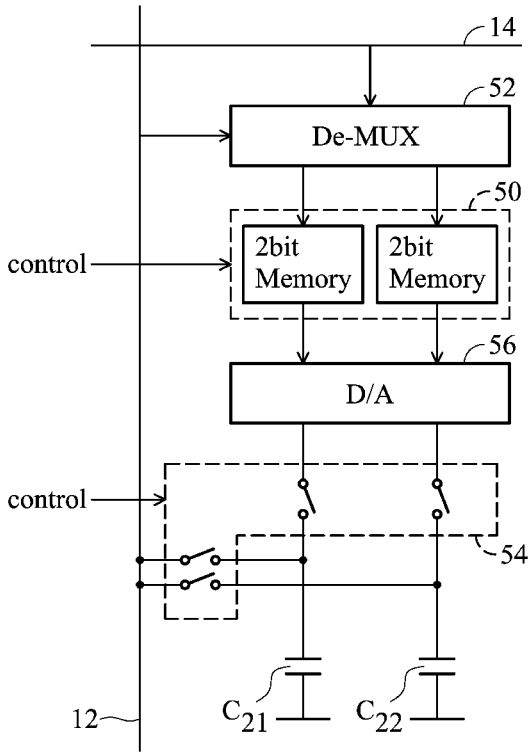

FIGS. 4*a* and 4*b* respectively show an alternative example of a structure and shape of a pixel utilizing the multi-bit MIP technology of an embodiment of the invention.

A pixel as shown in FIG. 4*a*, for example, is divided into a plurality of sub-pixels. The pixel P2 of FIG. 4*a* comprises two sub-pixels SP21 and SP22. Each sub-pixel is capable of white display, light gray, dark gray, or black display. In this example, the pixel P2 is capable of sixteen gradations of gray scale display, the same as the pixel P1 shown in FIG. 3*a*.

Structural boundary areas (not shown) respectively exist between each sub-pixel when a pixel is divided into a plurality of sub-pixels. The boundary areas are optically dead areas. Because the dead areas increase as more sub-pixels are divided, the aperture ratio is decreased. Thus, it is preferred to decrease the number of divided sub-pixels. However, the number of gradations which can be displayed by the pixel is also decreased as the number of sub-pixels decreases, thus hindering smooth display of neutral colors.

The pixel P2 comprises a circuitry as shown in FIG. 4*b*, for example, in order to keep high aperture ratio while achieving smooth neutral colors. The pixel P2 comprises two display components C21 and C22 such as liquid crystal cells or organic electroluminescence materials, a memory 50 comprising two two-bit memory areas disposed corresponding to each display component, a demultiplexer 52 dividing the digital image data transmitted through the source lines 12 from the source driver 20 into bits, a data switching department 54 switching providing either the memorized data in the memory 50 or the data transmitted through the source lines 12 for each display component, and a digital-analogue converting department (D/A) 56 converting the memorized data in the memory 50 from digital data to analogue data and outputting the converted data to each display component.

The demultiplexer 52 divides the digital image data provided by the source driver 20 into two unit bits according to gate signals transmitted from the gate driver 30 through the gate lines 14. In this example, the digital image data provided by the source driver 20 are digital data of four bits, such as 0000 through 1111, representing display gradations of the pixel P2. The more significant two bits and less significant two bits ("00", "01", "10", and "11") of the digital image data are respectively the gradation display data representing black/dark gray/light gray/white display of each sub-pixel. The demultiplexer 52 can extract the gradation display data comprised in the digital image data, and hold the extracted data, in the memory area, corresponding to each display component of the memory 50.

The data switching department 54 can switch to either provide the analogue image data transmitted through the source lines 12 for each display component in the moving picture display mode or provide the memorized gradation display data in the memory 50 for each pixel display in the still picture display mode according to the controlling signals from the control department 21 of the source driver 20. Here, because the memorized gradation display data in each memory area of the memory 50 are two-bit digital data, the memorized gradation display data cannot be provided for the display component in this data form. Here, the pixel P2 comprises the digital-analogue converting department (D/A) 56 converting the two-bit digital memorized data in each memory area of the memory 50 from digital data to analogue data. Specifically, the digital-analogue converting department (D/A) 56 can convert the two-bit digital memorized data in each memory area of the memory 50 to either of four analogue voltage values V1, V2, V3, and V4 that applying to each display component.

Each display component varies its optical property or emits light based on the analogue image data transmitted through the source lines 12 in the moving picture display mode, and on the other hand, based on the memorized gradation display data in the corresponding memory area of the memory 50 in the still picture display mode.

As described, the embodiments of the invention can be applied to a display device comprising pixels with various shapes and structures. Meanwhile, a four-bit MIP technology is utilized as an example to describe the shapes and structures of the pixel, but it is clear that the MIP may comprise less or more than four bits if the MIP comprises multi bits.

Further, in the multi-bit MIP technology, the image profile is represented by the least significant bit (LSB) in the digital data provided for each pixel. On the other hand, the detailed parts (hairs, eyes, nose, mouth, and etc., if it is an image of human beings, for example) in the profile are represented by the most significant bit (MSB). According to visual perception of human beings, it is known that human beings first identify the image profile, and then identify the detailed parts in the profile when observing an image. Here, the embodiments of the invention propose data input to each pixel starting from the least significant bit of the digital data when renewing images in the still picture display mode.

Figure 5:
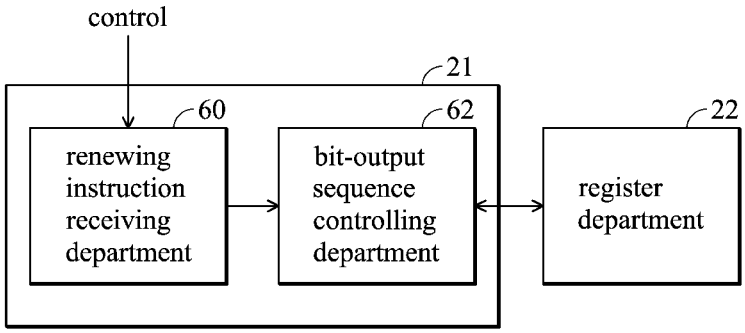
FIG. 5 shows a functional structure for image renewal of the control department in the source driver of an embodiment of the invention.

FIG. 5 shows a functional structure for image renewal of the control department in the source driver of an embodiment of the invention. The control department 21 comprises a renewing instruction receiving department 60 and a bit-output sequence controlling department 62, wherein the renewing instruction receiving department 60 receives an image renewing instruction acting as a control signal from the controller of the display device body, and the bit-output sequence controlling department 62 responds to the image renewing instruction and controls output of the digital data from the register department 22 in a sequence from the least significant bit.

Figure 6:
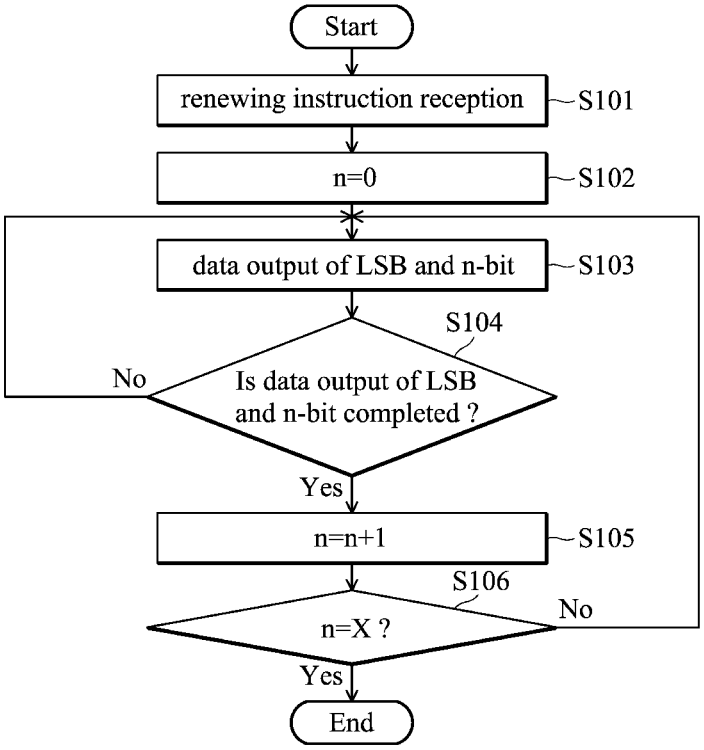
FIG. 6 is a flow chart of an image renewing action on one pixel of the source driver comprising the control department of FIG. 5.

An example of an image renewing action on one pixel performed by the source driver 20 comprising the control department 21 of FIG. 5 is shown in FIG. 6. Here, for example, the display device utilizes an X-bit MIP technology (X is a positive integer of 2 or greater), that divides one pixel into X sub-pixels.

In step 101, first, the control department 21 utilizes the renewing instruction receiving department 60 receiving an image renewing instruction to act as a control signal from the controller of the display device body. In step S102, next, the control department 21 utilizes the bit-output sequence controlling department 62 instructing the register department 22 to output the least significant bit data comprised in the digital data necessary to be provided for the pixel. Receiving the instruction, the register department 22 outputs the least significant bit data in step S103. Hereafter in step S104, the control department 21 confirms whether the register department 22 has completed output of the least significant bit data. When the output of the least significant bit data is completed, the control department 21 utilizes the bit-output sequence controlling department 62 instructing the register department 22 to output the more significant bit data, and next, the least significant bit in step 105. Receiving the instruction, the register department 22 outputs the corresponding bit data. The source driver 20 repeats the sequence of actions from the step S103 to the step S105 until confirming completion of the output of the most significant bit in step S106. According to the described actions, new digital data are input to the pixel, and the memorized data in the memory in pixel are renewed.

Since the image renewing action on one pixel performed by the source driver is described, the methods for renewing images of the entire display department comprise a first method, wherein the image renewing action in a pixel unit is performed with reference to FIG. 6, and a second method, wherein the image renewing action in a predetermined bit unit is performed. The first method is called a progressive data transmission method, and the second method is called a page data transmission method, and each transmission method is subsequently described.

Figure 7:
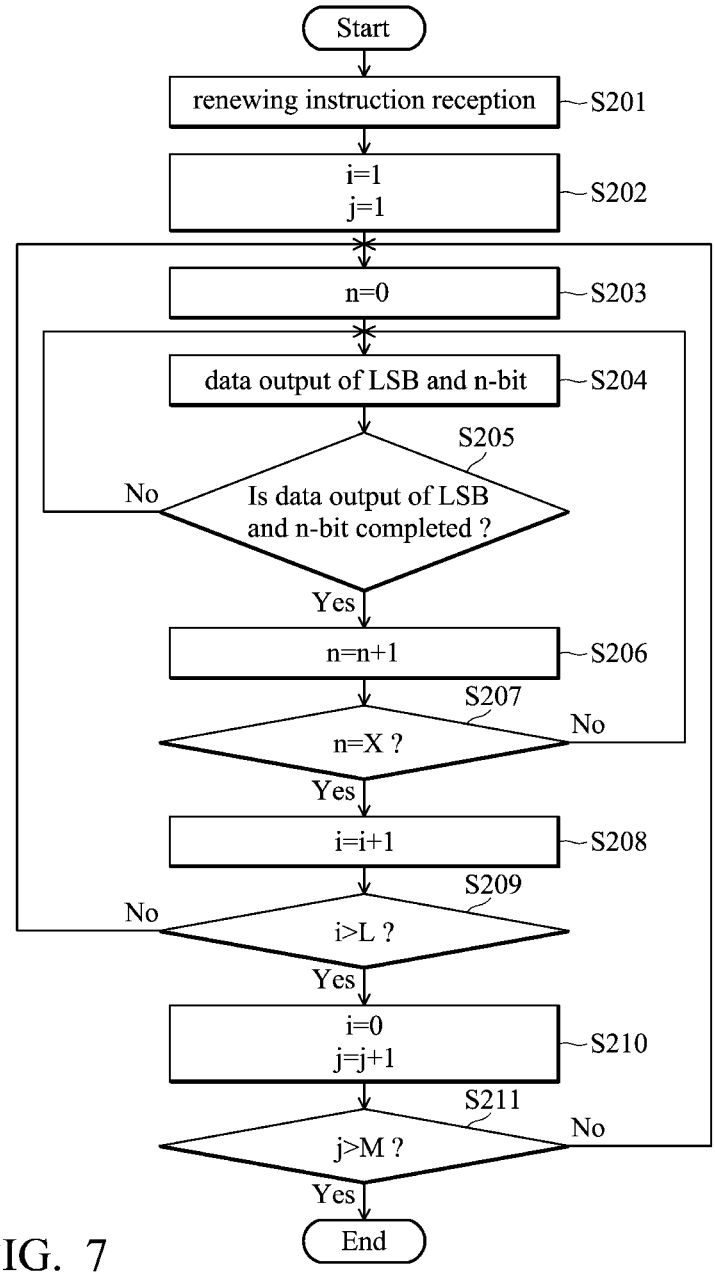
FIG. 7 is a flow chart of an image renewing action of a progressive data transmission method on the entire display department of the source driver comprising the control department of FIG. 5.

FIG. 7 is an example of an image renewing action of a progressive data transmission method on the entire display department of the source driver comprising the control department of FIG. 5. Here, for example, pixels are arranged in a matrix with L lines and M rows in the display department.

In step 201, first, the control department 21 utilizes the renewing instruction receiving department 60 receiving an image renewing instruction to act as a control signal from the controller of the display device body. In step S202, next, the control department 21 utilizes the bit-output sequence controlling department 62 instructing the register department 22 to output the digital data necessary to be provided for the pixel disposed in the first line and the first row in the pixel matrix arrangement on the display department. In step S203, further, the control department 21 utilizes the bit-output sequence controlling department 62 instructing to output the least significant bit data comprised in the digital data necessary to be provided for the formerly instructed determined pixel. Receiving the instruction, the register department 22 outputs the relating least significant bit data to the determined pixel in step S204. Hereafter in step S205, the control department 21 confirms whether the register department 22 has completed output of the least significant bit data. When output of the least significant bit data is completed, the control department 21 utilizes the bit-output sequence controlling department 62 instructing the register department 22 to output the more significant bit data, and next, the least significant bit in the digital data necessary to be provided for the present pixel in step 206. Receiving the instruction, the register department 22 outputs the corresponding bit data. The source driver 20 repeats the sequence of actions from the step S204 to the step S206 until confirming the completion of the output of all the related bit data to the present pixel in step S207.

In step S208, next, the control department 21 utilizes the bit-output sequence controlling department 62 instructing the register department 22 to output the digital data necessary to be provided for the next pixel disposed in the same line. Then, the source driver 20 repeats the sequence of actions from the step S203 to the step S208 until confirming the completion of the output of the related digital data to all the pixels in the same line in step S207.

In step S210, next, the control department 21 utilizes the bit-output sequence controlling department 62 instructing the register department 22 to output the digital data necessary to be provided for the pixel disposed in the next line and the first row. Then, the source driver 20 repeats the sequence of actions from the step S203 to the step S210 until confirming the completion of the output of the related digital data to all the pixels of the display department in step S211. According to the described actions, new digital data is respectively input to all the pixels of the display department, thus completing the data renewal of the entire display department.

Here, from the controller of the display device body, the digital image data is input to the register department 22 of the source driver 20 utilizing the line data corresponding to each line of the matrix arrangement of the pixels on the display department as one unit. Thus, by using the progressive data transmission method, the source driver 22 can output the received images in sequence, and the memory capacity thereof can be relatively small.

Figure 8:
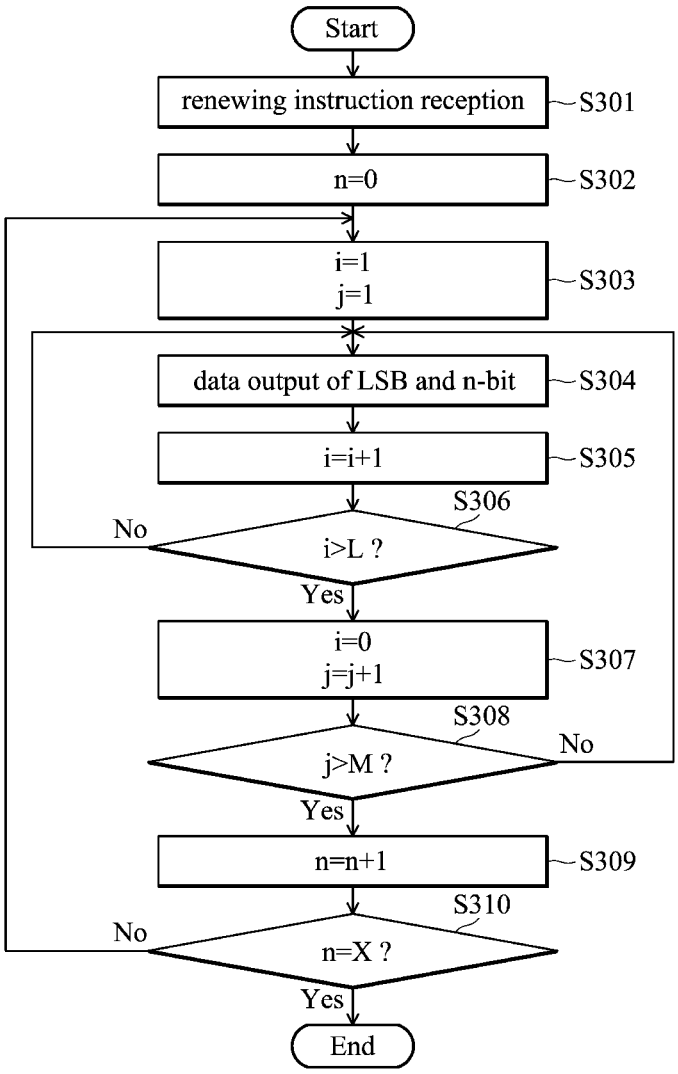
FIG. 8 is a flow chart of an image renewing action of a page data transmission method on the entire display department of the source driver comprising the control department of FIG. 5.

FIG. 8 is an example of an image renewing action of a page data transmission method on the entire display department of the source driver comprising the control department of FIG. 5. Here, for example, pixels are also arranged in a matrix with L lines and M rows in the display department.

In step 301, first, the control department 21 utilizes the renewing instruction receiving department 60 receiving an image renewing instruction to act as a control signal from the controller of the display device body. In step S302, next, the control department 21 utilizes the bit-output sequence controlling department 62 instructing the register department 22 to output the digital data necessary to be provided for each pixel in sequence starting from the least significant bit. In step S303, further, the control department 21 utilizes the bit-output sequence controlling department 62 instructing the register department 22 to output the respective corresponding least significant bit data to each pixel in sequence starting from the pixel disposed in the first line and the first row in the pixel matrix arrangement on the display department. Receiving the instruction, the register department 22 outputs the related least significant bit data to the determined pixel in step S304. In step S305, next, the control department 21 utilizes the bit-output sequence controlling department 62 instructing the register department 22 to output the related least significant bit data to the next pixel disposed in the same line. Then, the source driver 20 repeats the sequence of actions of the step S304 and the step S305 until confirming the completion of the output of the related least significant bit data to all the pixels in the same line in step S306.

In step S307, next, the control department 21 utilizes the bit-output sequence controlling department 62 instructing the register department 22 to output the least significant bit data to the pixel disposed in the next line and the first row. Then, the source driver 20 repeats the sequence of actions from the step S304 to the step S307 until confirming the completion of the output of the related least significant bit data to all the pixels of the display department in step S308.

In step S309, next, the control department 21 utilizes the bit-output sequence controlling department 62 instructing the register department 22 to output the more significant bit data next the least significant bit in the digital data necessary to be provided for each pixel. Then, the source driver 20 repeats the sequence of actions from the step S303 to the step S309 until confirming the completion of the output of the related most significant bit data to all the pixels of the display department in step S310. According to the described actions, new digital data are respectively input to all the pixels of the display department, thus completing the data renewal of the entire display department.

Here, as described, from the controller of the display device body, the digital image data is input to the register department 22 of the source driver 20 utilizing the line data corresponding to each line of the matrix arrangement of the pixels on the display department as one unit. Thus, in the page data transmission method, if the register department 22 does not receive all the line data, namely frame data, which displays the entire image, the register department 22 cannot output data, so the memory size thereof becomes larger than that in the progressive data transmission. However, because the image profile is first renewed in the whole entire display, the identification speed of image renewal according to viewers is higher than that in the progressive data transmission based on the mechanism of visual perception of human beings.

Meanwhile, the operations of the register department 22, the digital-analogue converting department 23, the buffering/amplification department 24, and the data path switching department 25 in the source driver is stopped by the control department 21 beyond the duration of the image renewing action.

Here, in order to simplify the description, the image renewing action is described by an example using a display device utilizing the X-bit MIP technology where one pixel is divided into X sub-pixels (X is a positive integer of 2 or greater). That is, each bit of the digital image data with X bits represents the respective gradations (black/white) of the X sub-pixels, and each pixel of the display device has a structure as shown in FIG. 3. However, of course the same image renewing action is also performed in the pixels comprising the structure as shown in FIG. 4. In these cases, from the source driver, data is output in sequence starting from the least significant bit in two or more bit units.

While the invention has been described by way of example and in terms of preferred embodiment, it is to be understood that the invention is not limited thereto. To the contrary, it is intended to cover various modifications and similar arrangements (as would be apparent to those skilled in the Art). Therefore, the scope of the appended claims should be accorded the broadest interpretation so as to encompass all such modifications and similar arrangements.

What is claimed is:

1. An active matrix display device, comprising:

a plurality of pixels arranged in a matrix with columns and rows; and a source driver configured to provide either analogue image data or digital image data for the plurality of pixels, wherein each of the plurality of pixels comprises a demultiplexer configured to divide the digital image data provided by the source driver into a plurality of bits representing gradation display data, and each of the plurality of pixels comprises a plurality of sub-pixels, and each of the plurality of sub-pixels comprises:

a display component;

a memory unit configured to memorize the gradation display data provided by the demultiplexer for the display component; and a data switching unit directly connected to the memory unit and a source line of the source driver, the data switching unit configured to switch data provided for the display component to either:

the memorized gradation display data in the memory unit, or the analogue image data provided by the source driver.

2. The device as claimed in claim 1, wherein the source driver is further configured to control the switching of the data switching unit depending on whether the analogue image data or the digital image data is provided for the plurality of pixels.

3. The device as claimed in claim 1, wherein each memory unit is a multi-bit memory configured to memorize the gradation display data which is digital data of two bits or more, and each of the plurality of pixels further comprises a digital-analogue converter configured to convert the gradation display data memorized in the corresponding multi-bit memories into analogue data.

4. The device as claimed in claim 1, wherein the source driver comprises a bit output sequence controlling unit configured to control data output of the source driver to provide the digital image data for the plurality of pixels in a sequence from a least significant bit of the digital image data when the memory units disposed in the plurality of sub-pixels of the plurality of pixels are to be renewed by new gradation display data.

5. The device as claimed in claim 4, wherein the bit output sequence controlling unit is configured to control output of the digital image data to the plurality of pixels in sequence, with the memory units in a previous pixel being renewed before the memory units in a subsequent pixel are renewed.

6. The device as claimed in claim 4, wherein the bit output sequence controlling unit is configured to control output of the digital image data to the plurality of pixels in a sequence from the least significant bit, with the memory units corresponding to a less significant bit being renewed in the plurality of pixels before the memory units corresponding to a more significant bit being renewed in the plurality of pixels.

7. The device as claimed in claim 1, wherein the active matrix display device is a liquid crystal display device.

8. The device as claimed in claim 1, wherein the active matrix display device is an organic light emitting diode (OLED) display device.

9. A portable machine, comprising the active matrix display device claimed in claim 1.

10. The device as claimed in claim 1, wherein the plurality of sub-pixels of each pixel includes a first sub-pixel at a corner of the pixel and a second sub-pixel extending along two adjacent sides of the first sub-pixel.

* * * * *